US011388948B2

(12) United States Patent
Zuborev et al.

(10) Patent No.: US 11,388,948 B2
(45) Date of Patent: Jul. 19, 2022

(54) FOOTWEAR WITH ADJUSTABLE HEIGHT PLATFORM AND INTERCHANGEABLE PLATFORM LAYERS

(71) Applicants: Boris Zuborev, Brooklyn, CT (US); Mark Kratter, Norwalk, CT (US)

(72) Inventors: Boris Zuborev, Brooklyn, CT (US); Mark Kratter, Norwalk, CT (US)

( * ) Notice: Subject to any disclaimer, the term of this patent is extended or adjusted under 35 U.S.C. 154(b) by 0 days.

(21) Appl. No.: 16/714,534

(22) Filed: Dec. 13, 2019

(65) Prior Publication Data

US 2020/0113275 A1 Apr. 16, 2020

Related U.S. Application Data

(63) Continuation-in-part of application No. 16/147,042, filed on Sep. 28, 2018, now abandoned.

(60) Provisional application No. 62/780,022, filed on Dec. 14, 2018, provisional application No. 62/726,169, filed on Aug. 31, 2018.

(51) Int. Cl.

| | |
|---|---|
| ***A43B 13/36*** | (2006.01) |
| ***A43B 9/14*** | (2006.01) |
| ***A43B 13/16*** | (2006.01) |
| ***A43B 13/32*** | (2006.01) |
| ***A43B 3/24*** | (2006.01) |

(52) U.S. Cl.

CPC ..... *A43B 9/14* (2013.01); *A43B 3/246* (2013.01); *A43B 13/16* (2013.01); *A43B 13/32* (2013.01); *A43B 13/36* (2013.01)

(58) Field of Classification Search

CPC ..... A43B 3/24; A43B 3/244; A43B 3/246; A43B 13/36

USPC ..... 36/15, 81, 100, 101; D2/897, 898, 948

See application file for complete search history.

(56) References Cited

U.S. PATENT DOCUMENTS

| | | | | | |
|---|---|---|---|---|---|
| 2,545,910 | A | * | 3/1951 | Aprile | A43B 5/00 36/132 |
| 3,538,628 | A | * | 11/1970 | Einstein, Jr. | A43B 23/24 36/15 |
| D238,216 | S | * | 12/1975 | Cohen | D2/897 |
| 4,176,459 | A | * | 12/1979 | Perser | A43D 1/02 33/3 R |
| D259,824 | S | * | 7/1981 | Shanks | D2/948 |
| D260,447 | S | * | 9/1981 | Greenblatt | A43B 23/24 D2/948 |
| D260,448 | S | * | 9/1981 | Greenblatt | D2/948 |
| D260,449 | S | * | 9/1981 | Greenblatt | D2/948 |
| 4,887,369 | A | * | 12/1989 | Bailey | A43B 3/24 36/101 |
| 5,177,883 | A | * | 1/1993 | Darby | A43B 3/26 36/103 |
| D343,948 | S | * | 2/1994 | Smith | D2/898 |
| 6,035,554 | A | * | 3/2000 | Duncan | A43B 3/108 36/100 |

(Continued)

*Primary Examiner* — Marie D Bays

(74) *Attorney, Agent, or Firm* — Handal & Morofsky LLC

(57) ABSTRACT

A footwear construction capable of incorporating one to three or more platform layers, or no platform layers at all. The invention comprises a kit including a sneaker member, optionally includable in the final construction first second and third platform members, guide members, optionally in sets of three, suitable for inclusion in a constructed footwear item with one, two or three platform members, and a tread its sole member, optionally replaceable by other types of soles.

10 Claims, 18 Drawing Sheets

(56) References Cited

U.S. PATENT DOCUMENTS 6,442,869 B2 * 9/2002 Coomes ..... A43B 3/0078 36/100
D564,189 S * 3/2008 Fojtu ..... D2/948
8,356,426 B1 * 1/2013 Daniel ..... A43B 13/36 36/15
8,910,399 B2 * 12/2014 Ickrath ..... A43B 7/38 36/81
D780,416 S * 3/2017 Huang ..... D2/952
2002/0174569 A1 * 11/2002 Tsai ..... A43B 3/246 36/101
2002/0178613 A1 * 12/2002 Williamson ..... A43B 13/36 36/15
2003/0200675 A1 * 10/2003 Gross ..... A43B 13/20 36/15
2003/0200676 A1 * 10/2003 Gross ..... A43B 13/36 36/15
2004/0194351 A1 * 10/2004 Gallegos ..... A43B 3/24 36/140
2005/0138840 A1 * 6/2005 Feldstein ..... A43B 13/36 36/8.3
2006/0021260 A1 * 2/2006 Kim ..... A43B 13/36 36/130
2006/0179682 A1 * 8/2006 O'Connor ..... A43B 3/246 36/11.5
2006/0277796 A1 * 12/2006 Gallegos ..... A43D 999/00 36/44
2009/0133288 A1 * 5/2009 Gallegos ..... A43B 13/223 36/91
2009/0193684 A1 * 8/2009 Diamond ..... A43B 3/0078 36/101
2010/0122473 A1 * 5/2010 Santos ..... A43B 1/0081 36/100
2014/0041257 A1 * 2/2014 Robinson ..... A43B 3/244 36/100
2015/0020414 A1 * 1/2015 Mulholland ..... A43B 5/001 36/100
2016/0081430 A1 * 3/2016 Carter ..... A43B 13/36 36/81
2016/0242504 A1 * 8/2016 Cowley ..... A43B 13/36
2017/0231316 A1 * 8/2017 Sethi ..... A43B 3/0031 36/97

* cited by examiner

FOOTWEAR WITH ADJUSTABLE HEIGHT PLATFORM AND INTERCHANGEABLE PLATFORM LAYERS

TECHNICAL FIELD

The invention relates to platform footwear, such as platform sneakers, wherein the user may vary the height of the platform.

CROSS REFERENCE TO RELATED APPLICATIONS (Not applicable)

STATEMENT REGARDING FEDERALLY SPONSORED RESEARCH OR DEVELOPMENT (Not applicable)

BACKGROUND OF THE INVENTION

A conventional article of footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured permanently to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially filled with gas. The polymer foam materials of the midsole may also absorb energy when compressed during ambulatory activities. The compression of the foam is affected by hysteresis loss, and deflection of such systems is affected by the volume of the compressed mass of the midsole.

The mechanical structures of the footwear must be capable of providing rigidity to accommodate in-use stresses while remaining compliant enough to provide impact absorption. The variety of rates, magnitudes and distributions of the loads encountered in use also require a non-buckling, progressive stiffness structure to properly handle different activities, surfaces, and uses of the footwear.

The prior art includes platform shoes as well as platform sneakers.

It would be desirable to provide a simple, highly efficient structure with low production costs and simplified manufacturing processes. It would also be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY OF THE INVENTION

The inventive footwear comprises an upper and an outsole with one to three platform inserts in between. The platform inserts are held in place by three metal screws which extend vertically from the upper through holes in the platform inserts. The screws can be removed and changed for screws of different sizes to accommodate a desired number of platform inserts.

The screws are each secured to the upper by means of a metal bolt and a metal washer which are embedded in the upper. Hook and loop fastening materials, such as those sold under the trademark Velcro, are used for secure platform inserts to each other and to the upper and the outsole. A layer of hooks is attached, for example, to the bottom of the upper by a layer of glue. The layer of hooks covers the bolts and washers and the screws protrude through the layer of hooks via holes. The layer of hooks attaches to a layer of loop material that is glued to the top of the platform insert. Each platform insert is made up of a layer of loops on top attached by a layer of glue to a layer of foam. A layer of hook material is attached to the bottom of the layer of foam by a layer of glue. Alternatively, the hooks and loops may be interchanged. The outsole includes a layer of loops attached to a layer of plastic with grooves by a layer of glue. The layer of hooks on the bottom of the upper attaches to the layer of loops on the top of the platform insert. The layer of hooks on the bottom of the platform insert attaches to either the layer of loops on the top of the next platform insert or the layer of loops on top of the outsole.

Further in accordance with the invention, an item of platform footwear or a kit for assembly of the same comprises a footwear housing configured to house the foot of a wearer. The footwear housing comprises (i) a footwear housing upper portion, and (ii) a footwear housing sole portion. The footwear housing sole portion has a bottom side. One or more platform layers have a top side and a bottom side, and are adapted to be secured to two other platform layers and/or to the bottom side of the housing sole portion. An outer sole is adapted to be secured to the bottom side of one of the platform layers and/or the bottom side of the housing sole portion.

The inventive platform shoe kit may comprise a housing portion for housing the foot of the wearer. A bottom portion supports the foot of the wearer. The bottom portion has an upper support surface.

One or more platform layer members may be adapted to be secured to one another and to the bottom portion of the housing portion.

A sole may be adapted to be secured to the bottom of one of the platform layers.

The apparatus may further comprise a plurality of alignment members securable to the bottom portion, and wherein the platform portions define holes for receiving said alignment members.

In accordance with the invention first connection members may be secured to the first sides of said platform layer members and second connection members may be secured to the second sides of said platform layer members. The second connection members may mate with and engage the first connection members.

A sole connection member may be secured to the sole member and adapted to be secured to one of the platform layer members.

The lower support surface of said bottom portion of said housing portion of said left shoe may be a mirror image of the lower support surface of said bottom portion of said housing portion of the right shoe. The first and second connection members may mate with each other. The bottom portion of the lower support surface of the housing portion of the left shoe kit may be adhered to one of the first connection members. The bottom portion of the lower support surface of the housing portion of the right shoe kit may be adhered to one of the second connection members. The sole connection member of the left shoe kit maybe adhered to one of the second connection members and the sole connection member of the right shoe kit maybe adhered to one of the first connection members, whereby said platform layer members may be used interchangeably in said right and left shoes.

The first and second connection members may be hook and loop fastening members.

The first and second connection members may be mating plastic snap members.

The first and second connection members may be north and south poles of magnetic members.

The platform layer members may be roughly flatish.

The housing portion, platform layer members and sole may be assembled together to form a shoe.

A plurality of alignment members may be securable to the bottom portion. The platform portions may define holes for receiving the alignment members.

A ribbon or lip member may hide the junction between adjacent parts of the shoe formed by the kit.

The platform layer members maybe sculptural.

The connection members may be snaps about which the platform layer members are molded.

The kit may further comprise a plurality of alignment members securable to the footwear housing sole portion, and wherein the platform portions define holes for receiving the alignment members.

The kit or shoe may further comprise an alignment member supports, the alignment member supports incorporating support surfaces and wherein the alignment members are configured to mate with and engage the support surfaces.

The alignment member support surfaces may comprise the threads of a tapped hole defined by the alignment member supports and the alignment members may comprise a threaded portion.

The alignment member support surfaces may comprise a bayonet retention surface and the alignment members may comprise a pair of bayonet studs.

The top surface of the platform layers and the outer sole are covered with a layer of a first type of attachment structure. The bottom surface of the platform layers and the bottom side of the footwear housing sole portion are covered with a layer of a second type of attachment structure the first type of attachment structure mating with the second type of attachment structure.

The first type of attachment structure may be a loop material. The second type of attachment structure may be a hook material.

One of the platform layers may be a three-dimensional sculpture.

There may be three of the platform layers, and the platform layers may be configured to form a smoothly flaring out member when engaged with one another.

The footwear housing may be a sneaker footwear housing, a leather shoe footwear housing, a sandal footwear housing or other type of footwear housing.

BRIEF DESCRIPTION OF THE DRAWINGS

The structure of the inventive platform footwear will become apparent from the following description of the invention applied in the context of a sneaker, taken in conjunction with the drawings, in which.

DETAILED DESCRIPTION OF THE PREFERRED EMBODIMENTS

As illustrated in FIGS. 1-4, the inventive customizable platform sneaker 10 comprises a sneaker portion 12. In accordance with the invention, it is contemplated that sneaker portion 12 may be replaced by a sneaker portion of any desired design such as the many sneaker designs which are currently on the market. Likewise, sneaker portion 12 may be replaced with a shoe portion, such as saddle shoes, wingtip shoes, Balmoral shoes, and so forth.

Figure 5:
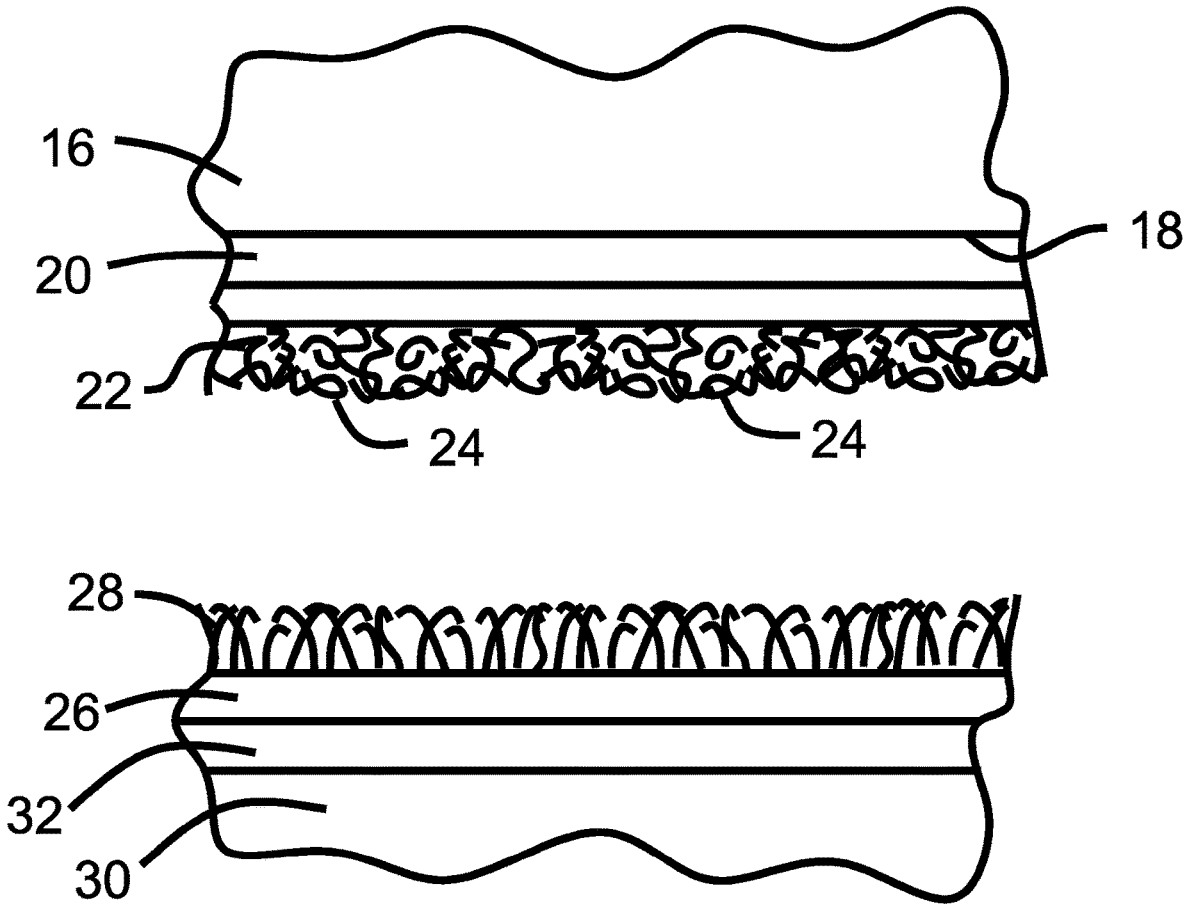
FIG. 5 is a cross-sectional diagrammatic view illustrating a detail of the construction of the platform sneaker of the present invention which enables one or more platform members to be used and result in a platform sneaker of varying height, or which, alternatively, enables assembly of the sneaker with a simple treaded sole without any platform member.

Sneaker portion 12 comprises a footwear upper portion 14 and a footwear sole portion 16. Sole portion bottom surface 18 (FIG. 5) bears a layer of glue 20, which secures Velcro attachment loop fabric 22 (such as that sold under the trademark Velcro), which, on its surface, includes numerous loops 24 and is of conventional design.

The next layer in the inventive sneaker 10 comprises attachment hook fabric 26 (such as that sold under the trademark Velcro). Attachment hook fabric 26 has hooks 28, and is of conventional design. Hooks 28 mate with loops 24. Attachment hook fabric 26 is secured to a platform layer 30 by a layer of glue 32. During use, hooks 28 engage loops 24 and provide adhesion between the bottom surface of sole portion 16 and the top portion of platform layer 30.

Similar to Velcro attachment fabric 22, attachment fabric 34 is glued to the bottom surface 36 of platform layer 30 and has hooks 38 on its bottom surface. Hooks 38 mate with loops 40 on the top surface of hook fabric 42. Hook attachment fabric 42 is glued to the top surface 46 of platform layer 44.

In similar fashion, attachment loop fabric 48 is glued to the bottom surface of platform layer 44. Attachment loop fabric 48 bears loops 50 on its bottom surface. Attachment hook fabric 52 bearing hooks 53 on its top surface is glued to the top surface 54 of platform layer 56.

The bottom surface 58 of platform layer 56 is glued to attachment fabric 60 which bears loops 62 on its bottom surface. Loops 62 mate with hooks 64 on the top surface of hook attachment fabric 66. Hook attachment fabric 66 is, in turn, glued to the top surface 68 of treaded outer sole 70 which includes treads 72 and heel 74.

The mating hooks and loops on adjacent hook attachment fabric layers and loop attachment fabric layers engage each other to provide for adhesion between the adjacent hook attachment fabric layers and loop attachment fabric layers. This combined with the action of the glue results in making the platform portion of the inventive shoe 10 a solid object.

Figure 1:
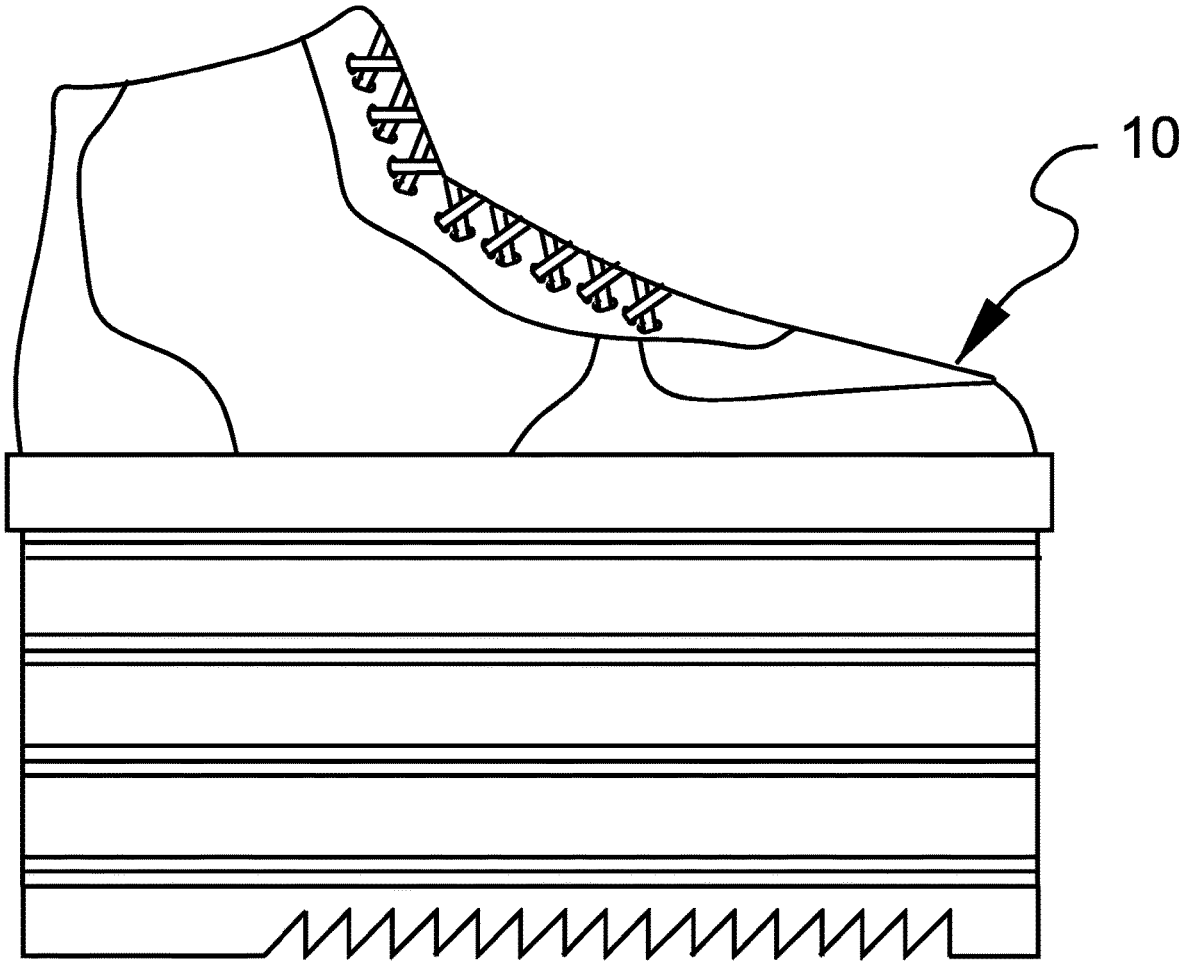
FIG. 1 is a side view of a sneaker illustrating a general implementation of the present invention.
Figure 2:
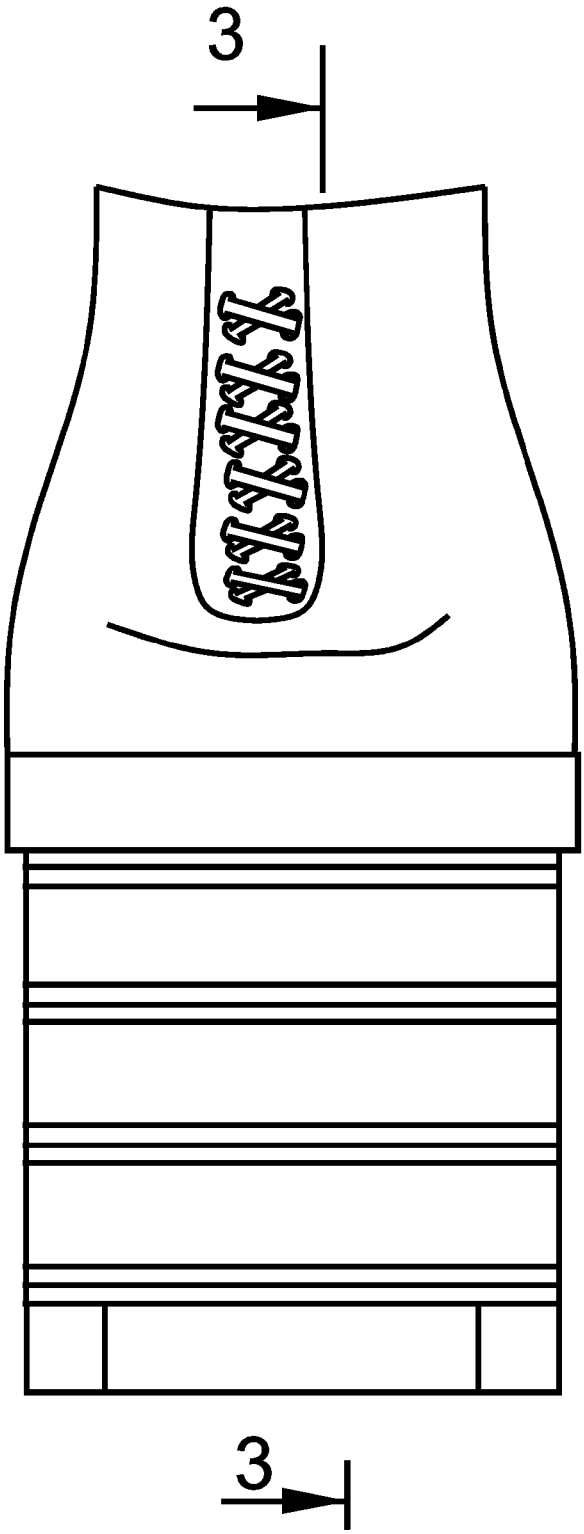
FIG. 2 is front view of the front of the inventive sneaker.
Figure 4:
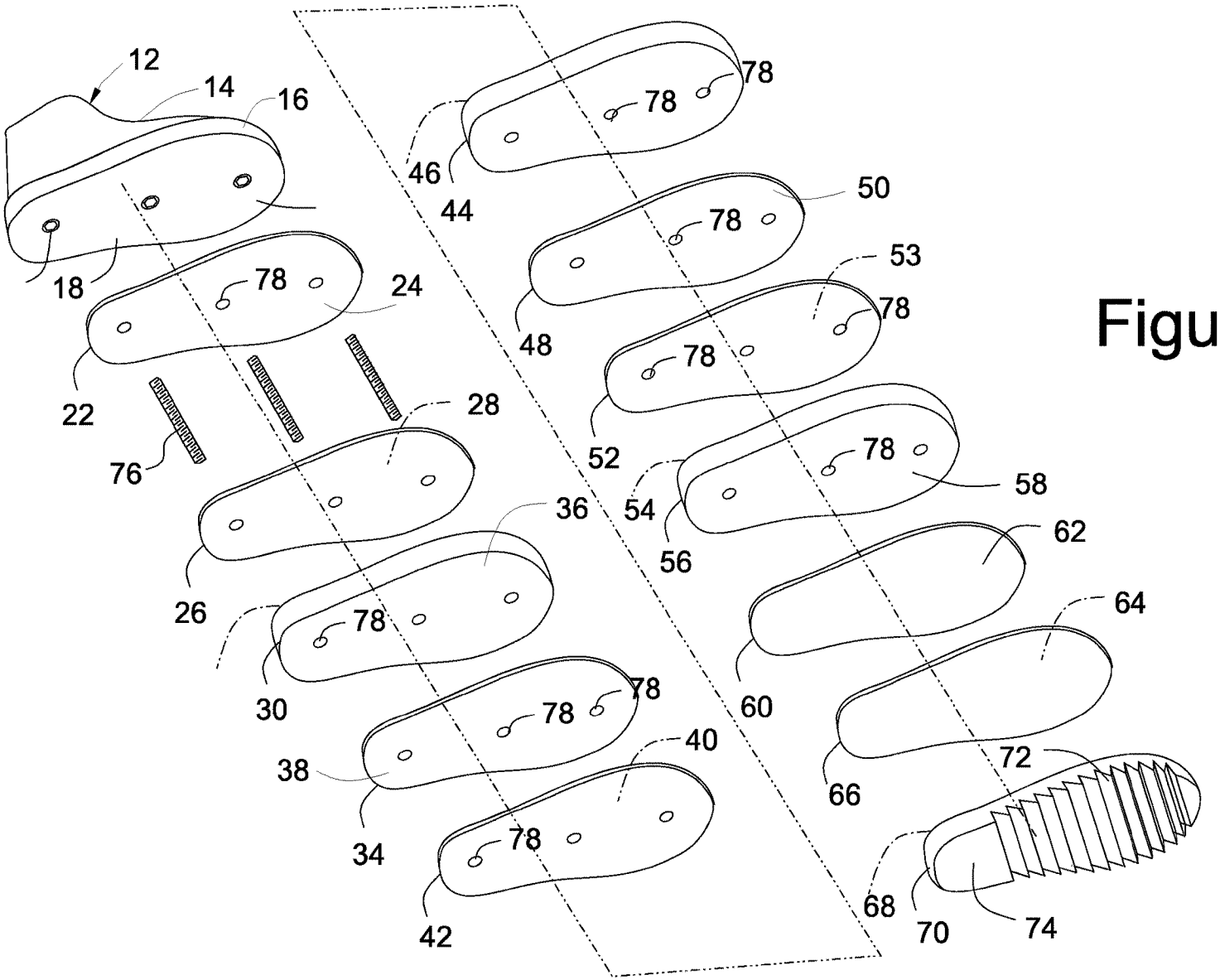
FIG. 4 is an exploded perspective view of the platform sneaker illustrated in FIGS. 1-3.

In accordance with the invention, it is contemplated that the parts illustrated in constructed form in FIG. 1, and illustrated in exploded perspective in FIG. 4 will be assembled by the user. Such assembly is facilitated by alignment members 76, which pass through holes 78 in the various members, and thus ensure proper positioning of the various elements of the inventive platform sneaker.

Figure 3:
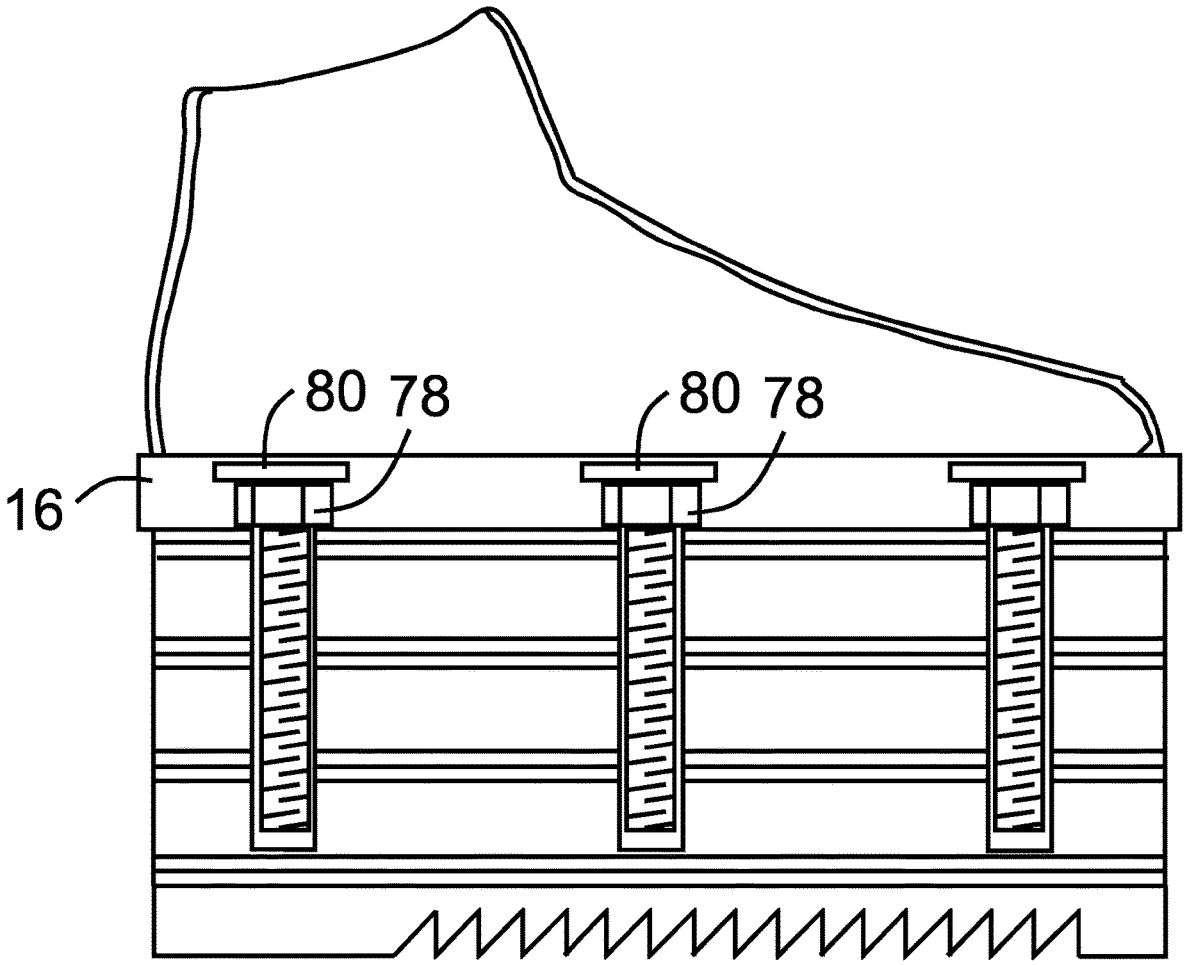
FIG. 3 is a class-sectional view of a platform sneaker constructed in accordance with the present invention along lines 3-3 of FIG. 2.

Referring to FIG. 3, alignment members 76 may be made of a simple threaded bar, and are secured to sole portion 16 by being screwed into threaded metal nuts 78. Nuts 78 may be of the type which are welded to a metal washer 80, thus ensuring that they are well anchored in sole portion 16. In accordance with the preferred embodiment, it is contemplated that sole portion 16 would be molded with nuts 78 and washers 80 in place during molding.

Alternatively, both the nut and washer may be injection molded of plastic, such as the polymer sold under the trademark Nylon.

Figure 6:
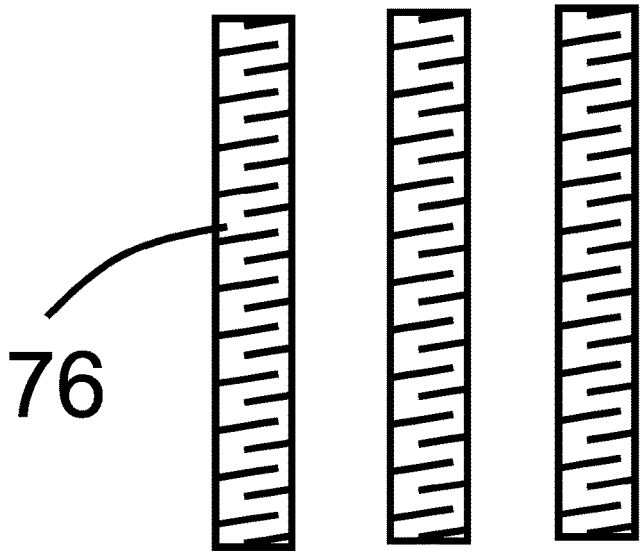
FIG. 6 illustrates alignment members for use in accordance with the embodiment of FIGS. 1-5 to result in a high platform.
Figure 7:
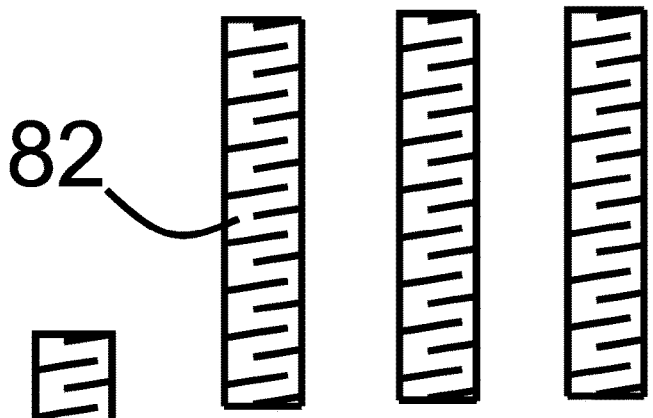
FIG. 7 illustrates alignment members for use with only two platform members resulting in a somewhat less elevated platform sneaker.

The three alignment members 76 included in the embodiment of FIGS. 1-5 are illustrated in FIG. 6. Alignment members 76 making made of metal or plastic. In accordance with the invention, it is contemplated that these three long alignment members would be used in the case of the assembly of a platform sneaker with three platform layers, thus resulting in a platform sneaker of relatively high dimension. If, on the other hand, it is desired to have a platform sneaker of somewhat shorter height, the alignment members 82 illustrated in FIG. 7 may be utilized.

Figure 8:
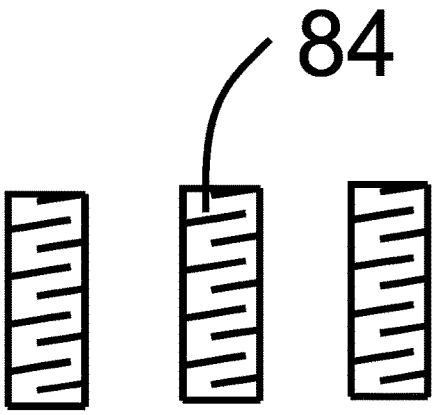
FIG. 8 illustrates alignment members for use with only one platform member resulting in a modestly elevated platform sneaker.

Alternatively, if relatively short platforms are desired, only a single platform layer may be used and the alignment members 84 illustrated in FIG. 8 may be employed.

Figure 9:
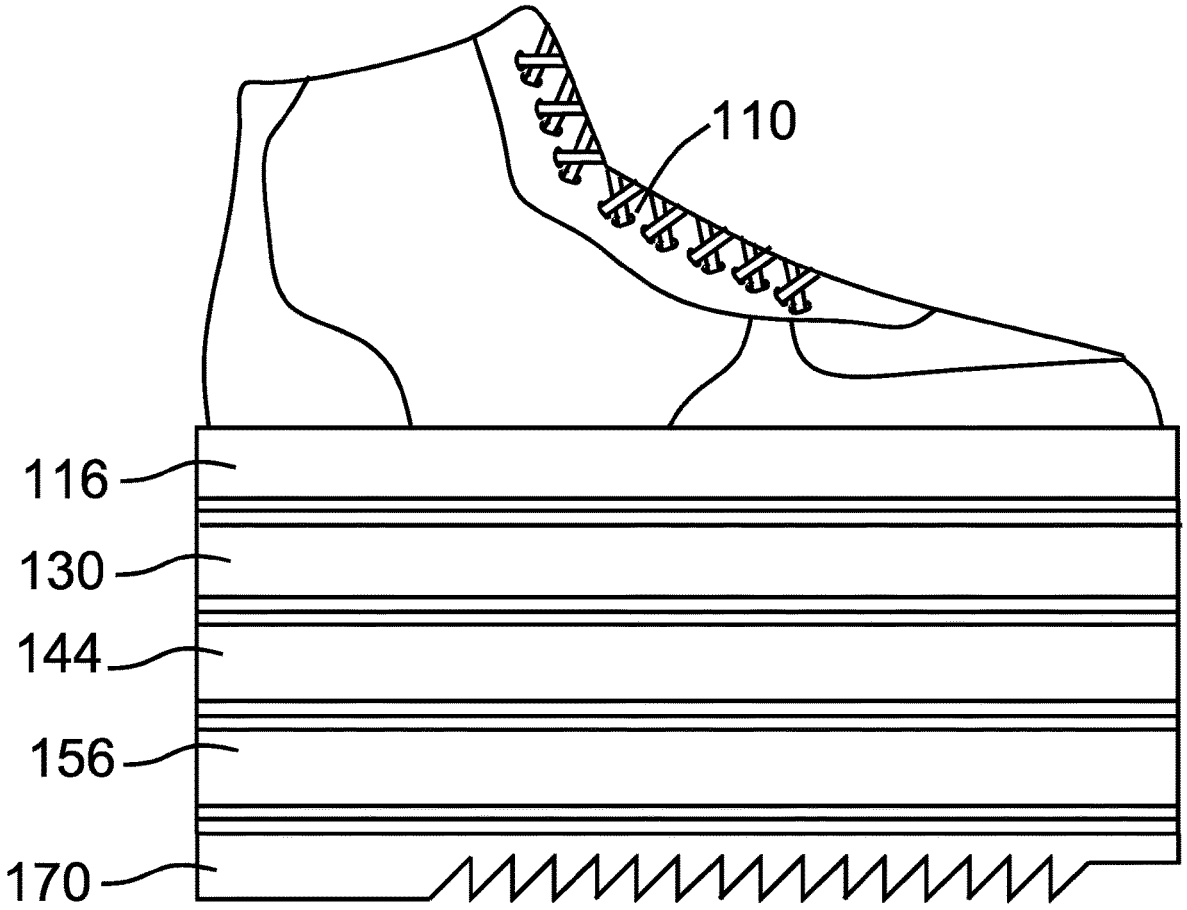
FIG. 9 illustrates a platform sneaker with a smooth uniform platform matching the sole of the sneaker portion of the platform sneaker.
Figure 10:
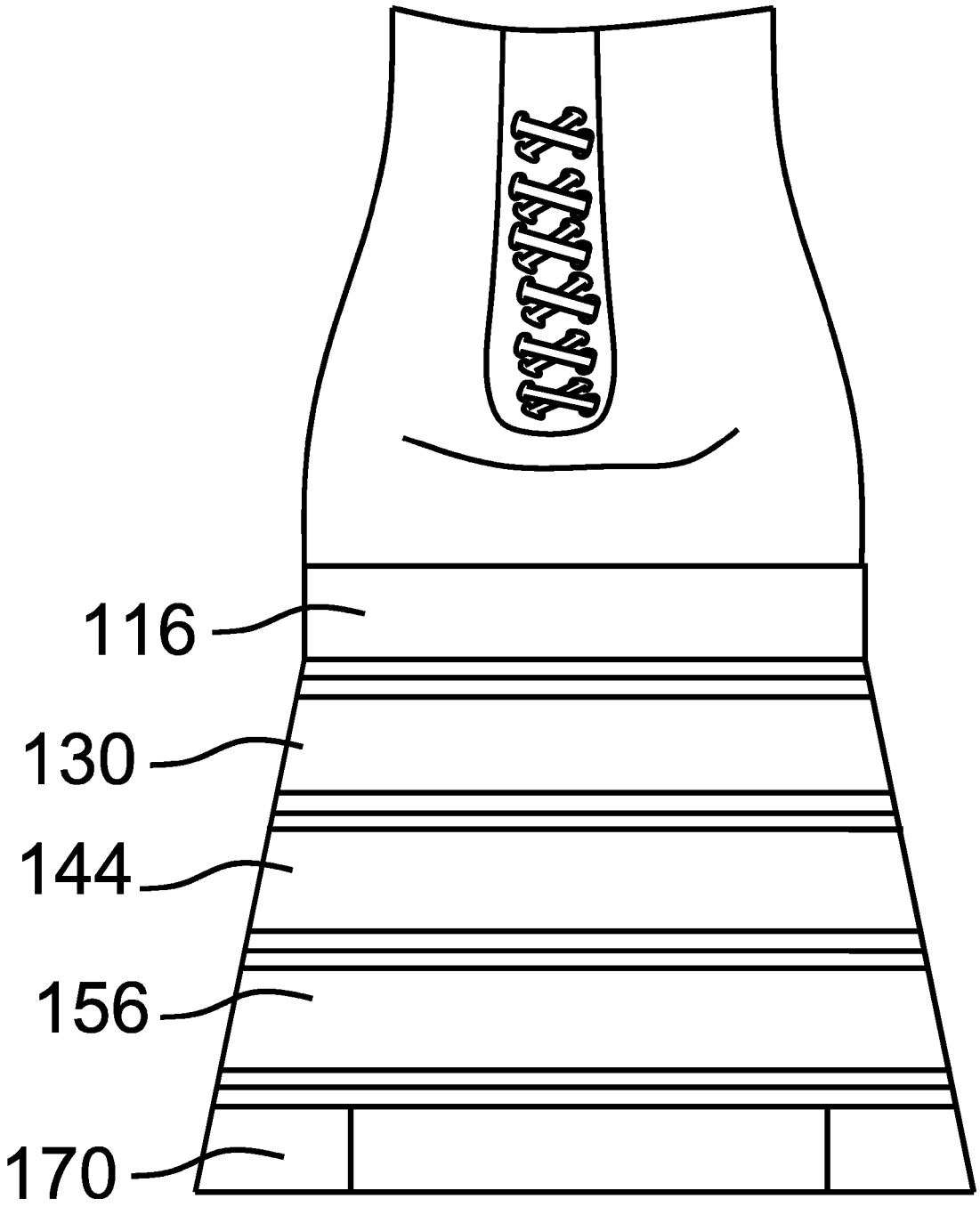
FIG. 10 is a front view of the platform sneaker of FIG. 9 illustrating its flared out width implemented for the purpose of imparting greater stability and ease of use two wearers who are not familiar with platform sneakers or who have not regularly use the same and may not have muscles strong enough to safely use the same.

Turning to FIG. 9, an alternative embodiment of an inventive sneaker 110 is illustrated. Sneaker 110 has three platform layers 130, 144, and 156 which match the shape of sole portion 116, and a tread member 170 for a smooth unitary appearance. Moreover, in order to enhance stability, as illustrated in FIG. 10, platform layers 130, 144, and 156 and sole portion 116 flare out in width.

Figure 13:
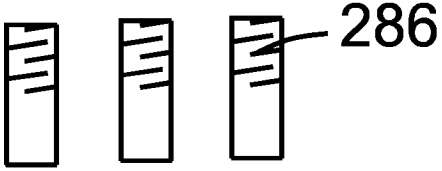
FIG. 13 illustrates yet another alternative guide member set with only partial threading suitable for use with a single platform member.
Figure 12:
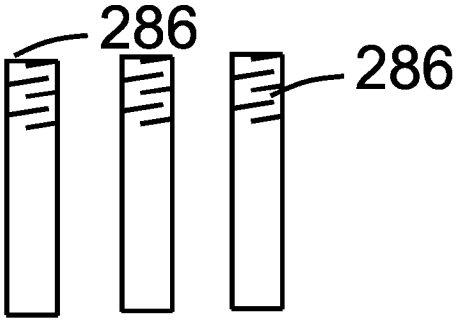
FIG. 12 illustrates an alternative guide member set with only partial threading suitable for use with two platform members.
Figure 11:
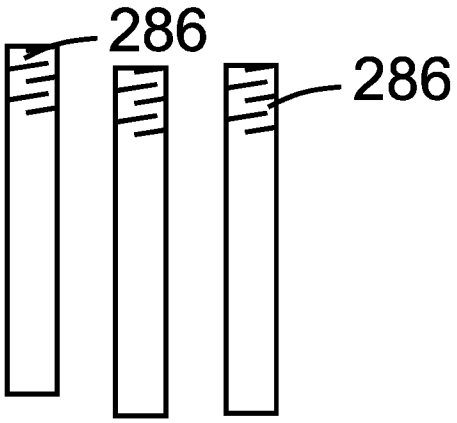
FIG. 11 illustrates an alternative guide member set with only partial threading suitable for use with three platform members.

Referring to FIGS. 11-13, alternative partially threaded alignment members 286 may be employed in the embodiments of FIGS. 1-10. In contrast to the alignment members in FIGS. 6-8, which are threaded along the entire length, the alignment members illustrated in FIGS. 11-13 are only threaded along a limited portion of their length, as illustrated. In accordance with the invention, it is contemplated that the three long alignment members of FIG. 11 would be used in the case of the assembly of a platform sneaker with three platform layers, thus resulting in a platform sneaker of relatively high dimension. If, on the other hand, it is desired to have a platform sneaker of somewhat shorter height, alignment members 286 illustrated in FIG. 12 may be utilized.

Alternatively, if relatively short platforms are desired, only a single platform layer may be used and the alignment members 286 illustrated in FIG. 13 may be employed.

In accordance with the invention, it is contemplated that the platform may be formed by any of a wide variety of arbitrary sculptural shapes, provided that the same provide the required mechanical support.

Figure 14:
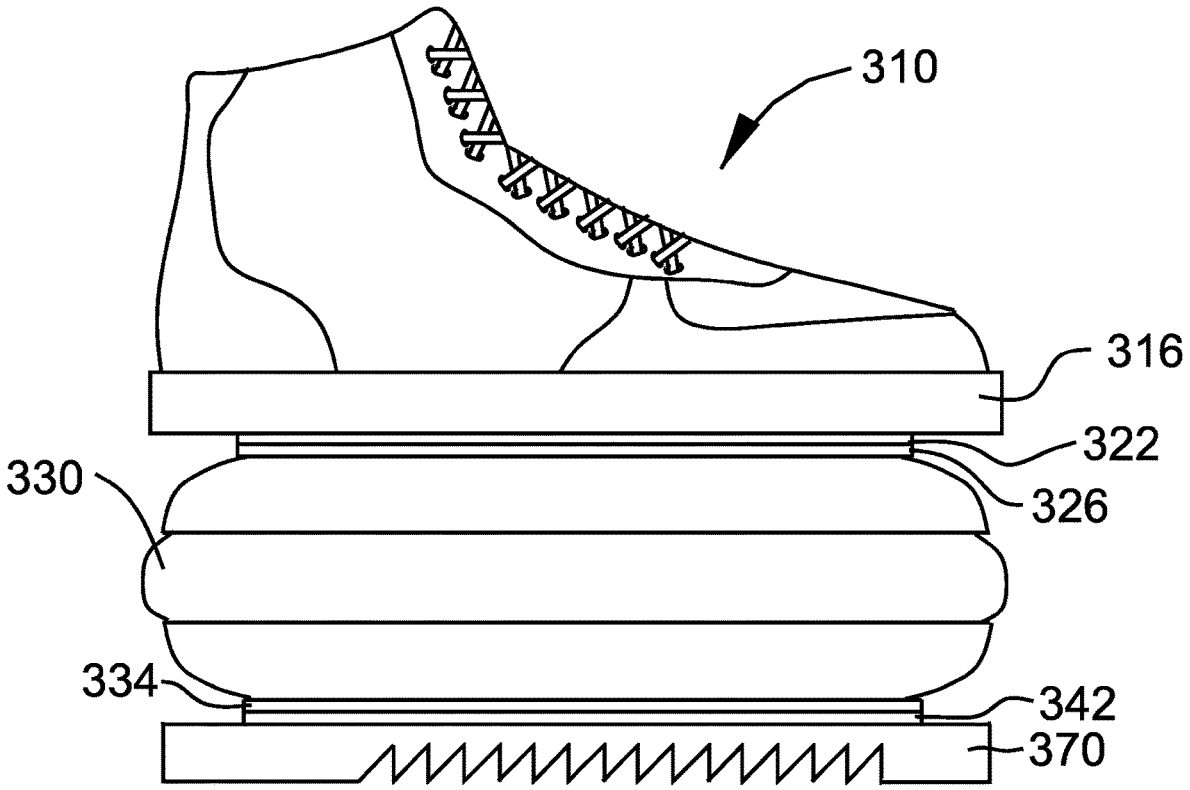
FIG. 14 illustrates an alternative embodiment of the invention featuring a hotdog sculpture.

Referring to FIG. 14, a sneaker 310 constructed in accordance with the present invention is illustrated. The platform effect is achieved, in part, in sneaker 310 by a hotdog shaped sculpture 330, in this case comprising a hotdog between a pair of hotdog roll halves.

Sculpture 330 is glued to loop attachment fabric loop 326. Loop attachment fabric 326 mates with hook attachment fabric 322 which is glued to the underside of sole portion 316. In similar fashion, the bottom of sculpture 330 is glued to hook attachment fabric 334 which mates with loop attachment fabric 342. Loop attachment fabric 342 is glued to the top of tread member 370.

Figure 15:
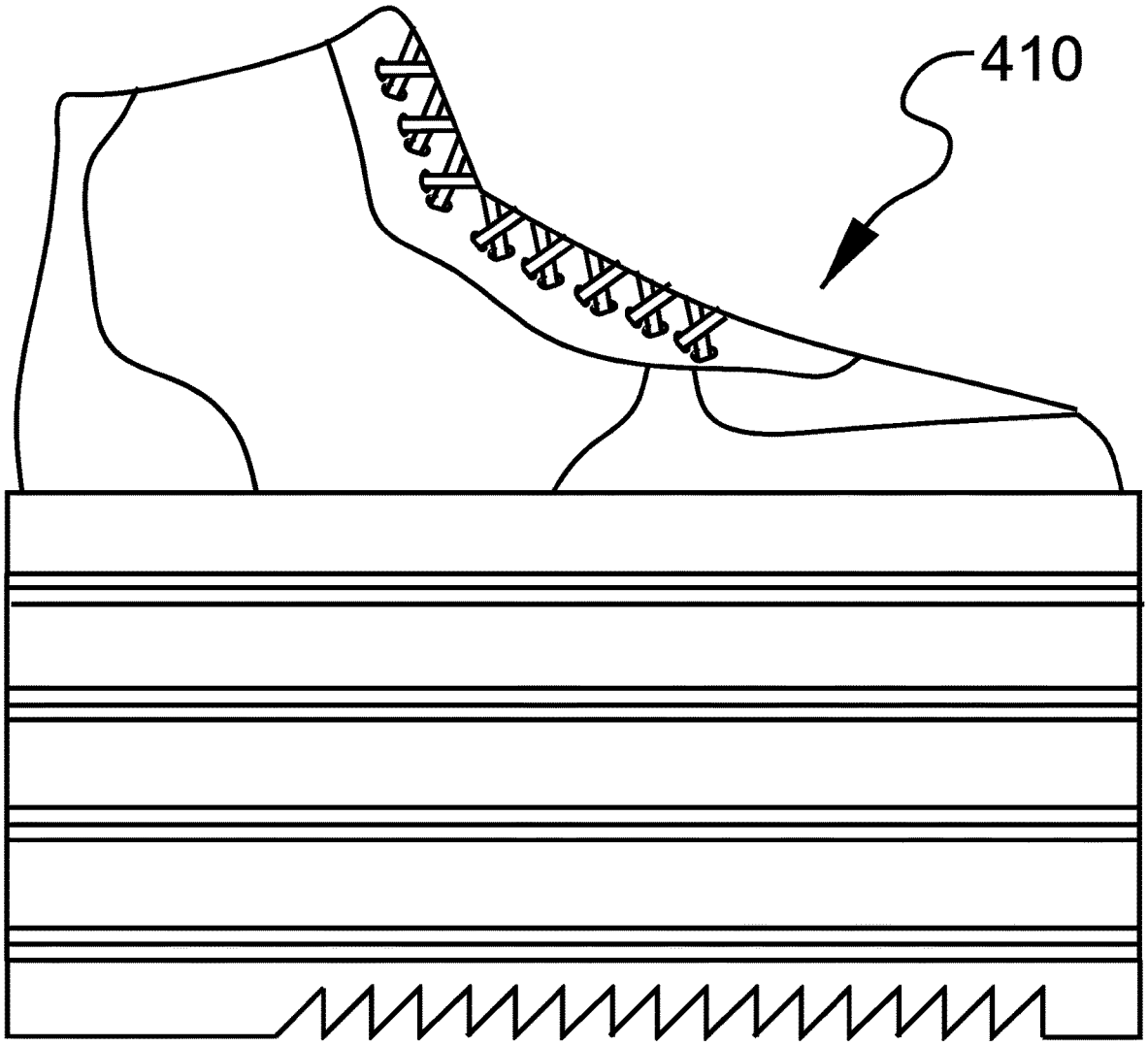
FIG. 15 illustrates an alternative embodiment of the invention in which the platform smoothly conforms to the shape of the sole of the sneaker portion of the sneaker.
Figure 16:
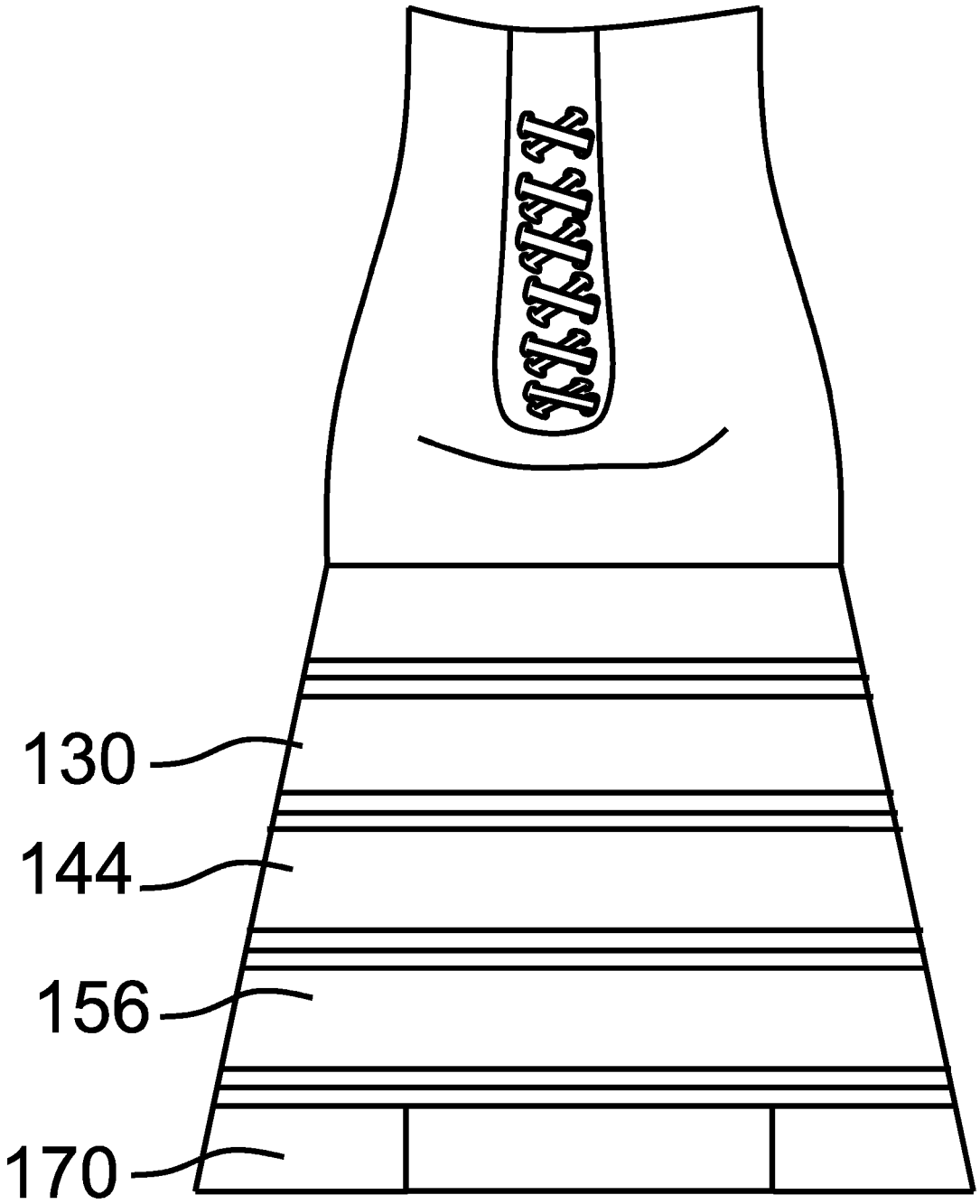
FIG. 16 is a front view of the sneaker of FIG. 15.

Turning to FIGS. 15-16, a sneaker 410 constructed in accordance with the present invention and featuring sole and platform members which match the shape of the platforms and the sole of the speaker portion of the inventive sneaker is illustrated. As illustrated in FIG. 16, the width of the inventive platform sneaker 410 may be flared out for stability.

In accordance with the invention, it is contemplated that more than three or fewer than three platform layers may be employed. Likewise, it is contemplated that the platform layers may be printed with decorative markings, such as stars, smile faces, thumbs-up signs, and so forth. In addition, platform layers may be of various thicknesses, for example ranging from 0.5 cm to as large a platform as the wearer is able to walk on, for example, 25 cm or even thicker. The same can be included in a kit form including a number of platform layers, alignment posts, shoe housings and outer soles. Multiple housings may also be provided, allowing the user to change the look of his shoes from day to day, or even from hour to hour.

What is referred to herein as an "outer soul" or an "outsole" is the layer of sole that is exposed to the ground. Due to the amount of wear and stress this part of the shoe receives it is usually made of a very durable material. It is also important that it provides enough friction with the floor to prevent the wearer from slipping. This can be done by the provision of treads or other articulations in the surface of the outer soul.

In accordance with the invention, it is contemplated that the user will put the platform shoe together using the Velcro™-type fastener material. Later the user may elect to take the shoe apart and either add an additional platform layer or layers, or remove some of the platform layers, or switch them out for different layers or sculptures. Multiple sculptures are also possible, for example, platform layers may comprise such things as the top and bottom of a hotdog bun, a hotdog, a layer of sauerkraut, a mouse, or anything likely to project a desired aesthetic.

An alternative kit approach is to dispense with the use of Velcro™-type fastener and, instead, provide the user with a of glue to permanently secure the desired platform layers in position to the outer sole and the housing of the shoe. It is contemplated that multiple parts may be included in the kit allowing the user to select those parts which he wishes to use and construct a platform show of suitable height and style.

Also, in accordance with the present invention, it is possible to dispense with use of the alignment members. For example, the platform layers may be aligned by eye and secured with the hook and loop fabric fasteners.

Figure 17:
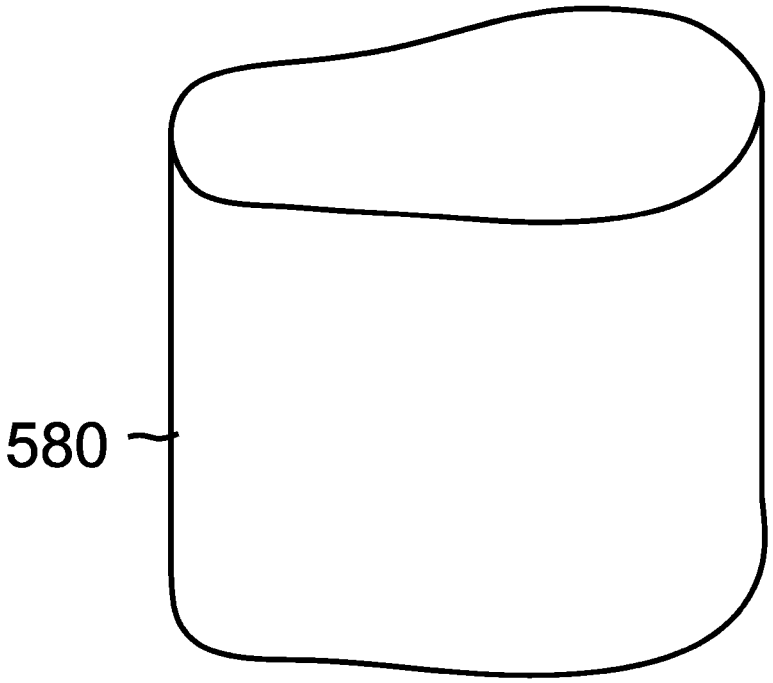
FIG. 17 is a perspective view of a cylindrical member for accurately aligning the outsole and platform layers with the upper shoe housing during assembly of the inventive platform footwear.
Figure 18:
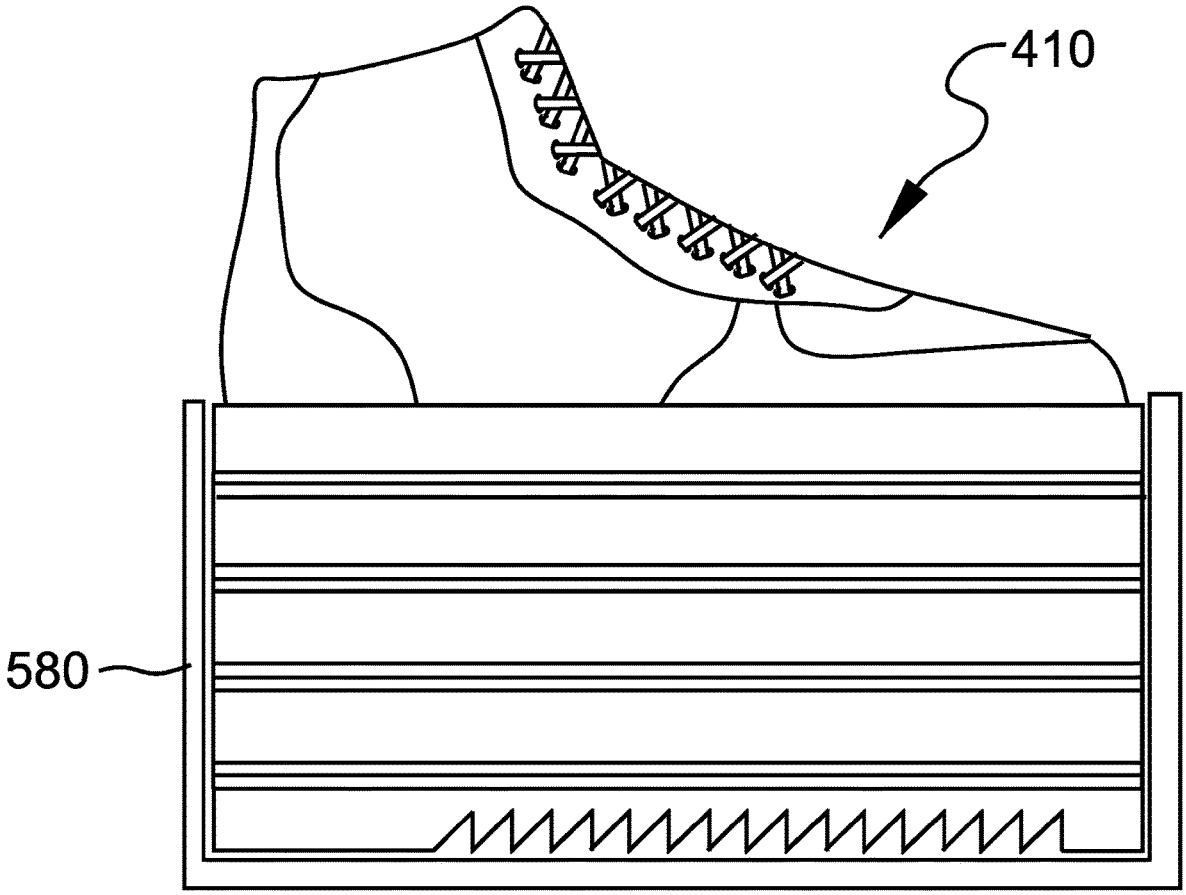
FIG. 18 is a cross-sectional view of the cylindrical member of FIG. 17.

Still yet another alternative in accordance with the present invention is the use of an outside cylindrical guide 580 whose cross-section matches the cross-section of the outsole and platform layers, as illustrated in FIGS. 17-18. In FIG. 17, guide 580 is illustrated in perspective, while in FIG. 18, guide 580 is illustrated in cross-section with the inventive footwear. In accordance with this embodiment, when it is desired to assemble the inventive platform footwear, the outsole is first put into cylindrical guide 580. Next any number of platform layers are inserted into guide 580 and each secured to the layer underneath. Finally, the footwear upper portion is inserted into guide 580 and the shoe is completed. In this arrangement, the platform footwear is held together only by the hook and loop attachment layers, which are glued to their respective footwear upper portion, platform layers and outsole.

In accordance with the invention, platform layers need not be of uniform thickness. For example, they can be sloped to be thinner in the front and thicker toward the heel (for example simulating the effect of a raised heel), or vice versa. In this sort of arrangement, the distance that the heel is raised may be varied by the selection of an appropriate platform layer or multiple platform layers. Likewise, layers, for example of different colors, which slope upwardly at the heel may be combined with layers which slope downwardly at the heel to provide an interesting aesthetic when viewed from the side.

Figure 19:
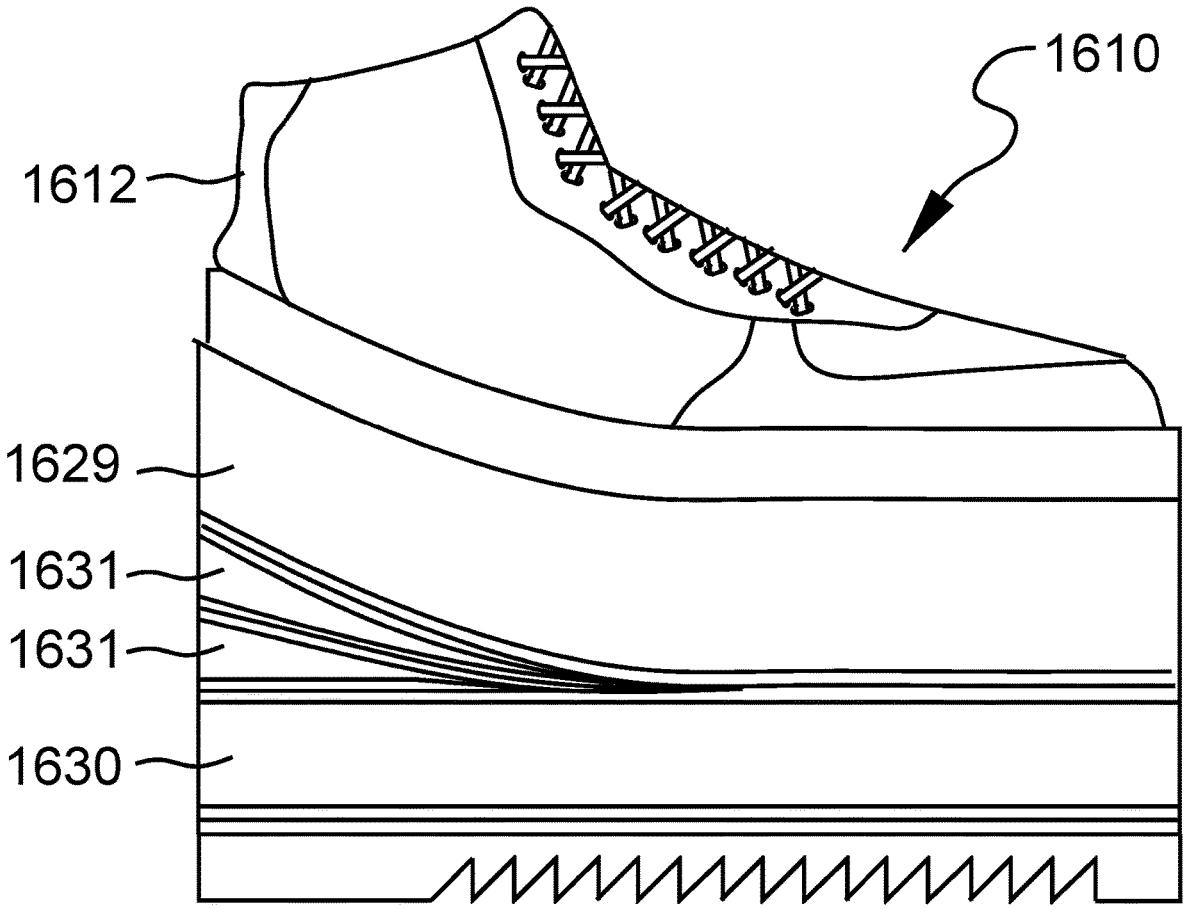
FIG. 19 is a view of yet another alternative embodiment of the invention.

For example, as illustrated in FIG. 19, the inventive footwear 610 may include a flat platform layer 1630 such as that illustrated in FIGS. 1-18, but may also include a curved platform layer 1629 and a plurality of wedge shaped platform layers 1631. As a yet further alternative, wedge shaped layers 1631 may be permanently incorporated into sneaker portion 1612, and only flat platform layers used.

Figure 20:
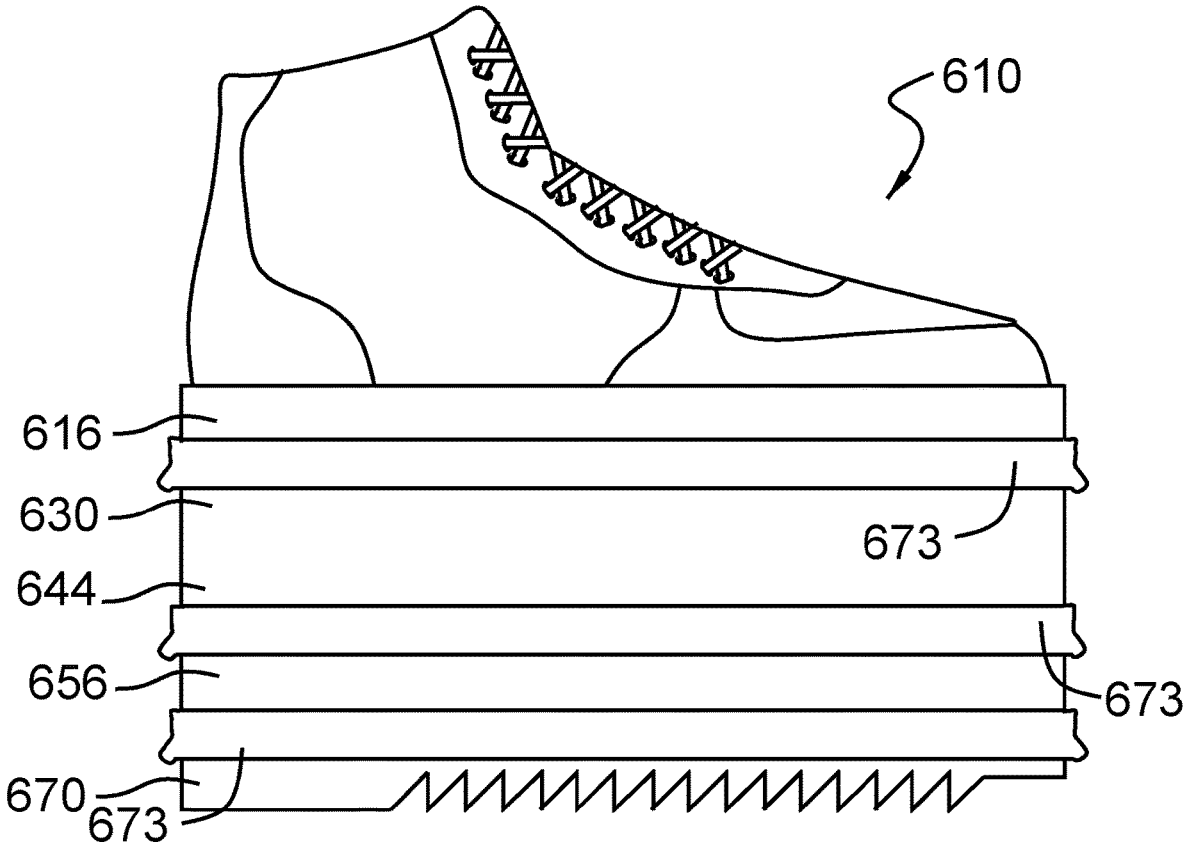
FIG. 20 is a side view of another alternative embodiment of the inventive platform sneaker.
Figure 21:
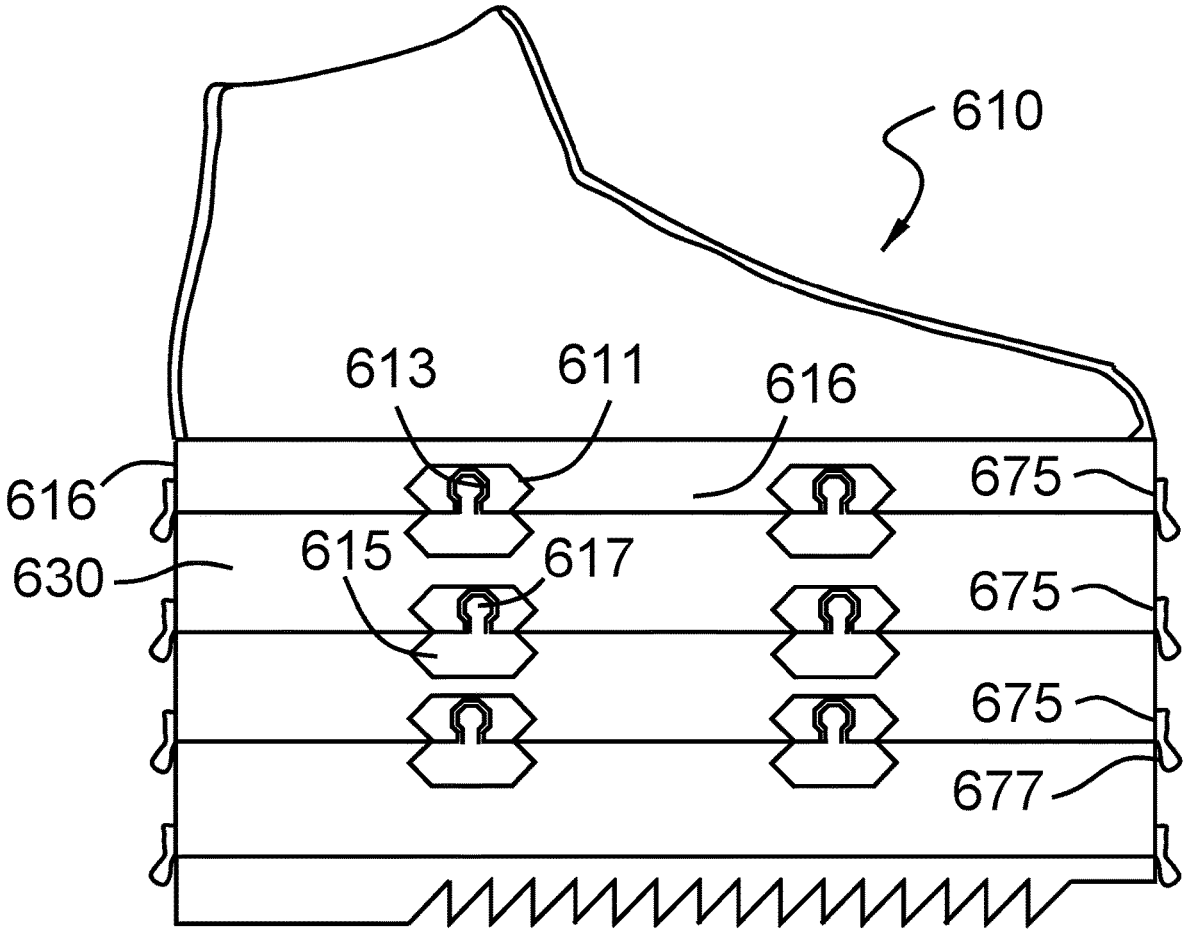
FIG. 21 is a cross-sectional view of the sneaker of FIG. 20.

Turning to FIGS. 20 and 21, another alternative embodiment of the inventive platform sneaker 610 is illustrated. In this embodiment, sneaker 610 is constructed in a manner substantially identical to that of the early embodiment except as noted. More particularly, sneaker 610 includes a sole portion 616. Sole portion 616 is made of rubber (for example high density foam rubber) which may be made by being injected into a mold. A snap receiving member 611 is placed in the mold prior to injection molding, whereby snap receiving female member 611 has the rubber of which sole portion 616 is made molded around and secured to snap receiving member 611.

Female snap member 611 may be made of a relatively rigid plastic, typical of mechanical snaps. Female snap member 611 has a socket 613 incorporated therein.

A platform layer 630 incorporates a male snap member 615. Integrally formed with male snap member 615 is a knob 617. Knob 617 mates with socket 613. Knob 617 and female snap member 611 are both made of similar or the same materials and may be made by injection molding.

As illustrated mostly clearly in FIG. 18, sole portion 616 secured to platform layer 630 by the action of female snap member 611 and male snap member 615. FIG. 8, for purposes of illustration, three pairs of snap members 611, 615 are illustrated. In accordance with the preferred embodiment, the snap members would be smaller than illustrated and would be distributed across the length and the width of platform layer 630. For example, fifteen snap member might be used to secure platform layer 632 sole portion 660.

Likewise, fifteen pairs of snap members 611, 615 may be used to secure platform layer 630 to platform to layer 656. Similarly, fifteen pairs of snap members 611, 615 may be used to secure platform layer 656 to treaded sole 670.

In accordance with the embodiment of FIGS. 20-21, the aesthetic appearance of the shoe is improved through the use of overlying ribbon members 673. Uppermost ribbon member 673 is secured to sole portion 616 at surface 675. It may be secured using glue, heat activated glue, or other type of glue. Alternatively, the solvent may be used sole portion 616 and ribbon member 673 to form a dope which allows the two members to be secured to each other.

Ribbon members 673 also include a lower portion 677 which overlies the platform layer or the treaded sole below the element to which they are secured. For example, sole portion 616 overlies platform layer 630. The respective ribbon member 673 is secured to sole portion 616, but is not secured to platform layer 630. This allows platform layer 630 to be slid against the inside of ribbon member 673 during installation of platform layer 630, resulting in engagement between male and female snap members 611 and 650. More particularly, knobs 617 slip and snap into sockets 613, resulting in securely binding sole portion 616 to platform layer 630.

Figure 22:
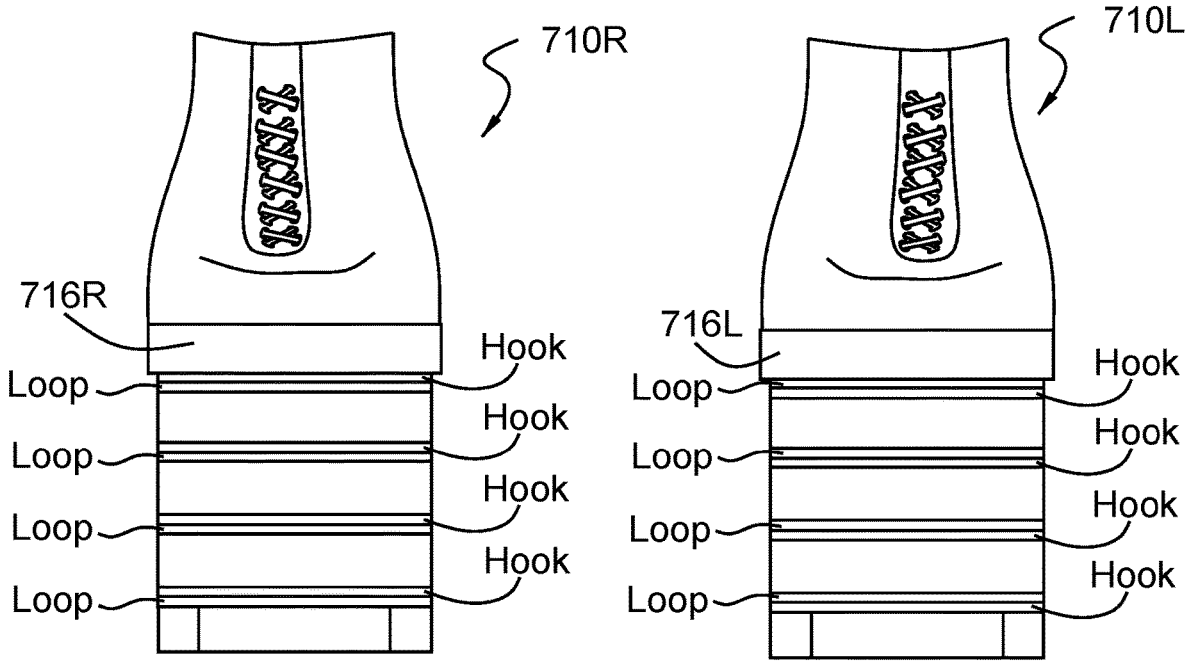
FIG. 22 is a front view of a pair of yet another alternative embodiment of the inventive sneakers.

FIG. 22 is a front view of a pair of sneakers yet another alternative embodiment of the inventive sneakers. In accordance with this embodiment of the inventive platform sneakers (including a left sneaker 710L and the right sneaker 710R), additional conveniences provided by configuring all platform layers to be interchangeable. More particularly, as between the left and right foot, platform layers for the respective left and right sneakers are mirror images of each other. By "reversing" the type of connector put on the various parts of the inventive sneaker, platform members which could be positioned on the left sneaker may be flipped over and used on the right sneaker.

However, in order to work in the right sneaker, the right sneaker must have the opposite type of mating connector. Thus, sole portion 716L may be provided with loop-type fastening elements, while sole portion 716R may be provided with hook-type fastening elements. This carries over to the other layers. More particularly, as illustrated in FIG. 22, in the right sneaker, a hook fabric is used on the bottom of the sole portion and the platform layers, and a loop fabric is used on the top of the platform layers and treaded sole.

Similarly, also as illustrated in FIG. 22, in the left sneaker, a loop fabric is used on the bottom of the sole portion and the platform layers, and a hook fabric is used on the top of the platform layers and treaded sole.

It is noted that this methodology, as illustrated in FIG. 22, may be used no matter what type of connection is used to assemble the sneakers. For example, hook fabric may be replaced by male snaps and loop fabric may be replaced by female snaps for a snap version of the system.

Likewise, hook and loop fabrics may be replaced magnets, for example vinyl polymeric magnets, with hook fabric being replaced by exposed magnet north poles and loop fabric being replaced by replaced by exposed magnet south poles.

For example, as illustrated in FIG. 22, the inventive footwear 710 may include a flat platform layer 730 such as that illustrated in FIGS. 1-18, but may also include a curved platform layer 729 and a plurality of wedge shaped platform layers 731. As a yet further alternative, wedge shaped layers 731 may be permanently incorporated into sneaker portion 712, and only flat platform layers used.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. A platform shoe kit for a shoe with a platform of selectable configuration, comprising:

(a) a housing portion for housing the foot of the wearer and comprising a bottom portion for supporting the foot of the wearer, said bottom portion having an upper support surface for supporting the foot of the wearer, and a lower support surface;

(b) one or more platform layer members, said platform layer members being securable to one another and to said bottom portion of said housing portion, and having first and second surfaces;

(c) first connection members secured to the first sides of said platform layer members;

(d) second connection members secured to the second sides of said platform layer members, said second connection members mating with and engaging said first connection members;

(e) a sole member;

(f) a sole connection member secured to said sole member and securable to one of said platform layer members;

(g) a plurality of alignment members securable to respective anchors on said bottom portion, wherein said platform layer members define holes for receiving said alignment members, said holes allowing for the alignment members to pass through and be retained by said platform and to reach said bottom portion of said housing; and (h) a ribbon or lip member that overlies and hides the junction between adjacent parts of the shoe formed by said kit.

2. A kit as in claim 1, wherein at least one platform layer member flares outward having a tapered edge increasing in size from a top surface of said platform layer member to a bottom surface of said platform layer member.

3. A kit as in claim 2, wherein a combination of multiple flared-out platform layer members provides an increase in footprint size and stability.

4. A platform shoe kit for a shoe with a platform of selectable configuration, comprising:

(a) a housing portion for housing the foot of the wearer and comprising a bottom portion for supporting the foot of the wearer, said bottom portion having an upper support surface for supporting the foot of the wearer, and a lower support surface;

(b) one or more platform layer members, said platform layer members being securable to one another and to said bottom portion of said housing portion, and having first and second surfaces;

(c) first connection members secured to the first sides of said platform layer members;

(d) second connection members secured to the second sides of said platform layer members, said second connection members mating with and engaging said first connection members;

(e) a sole member;

(f) a sole connection member secured to said sole member and securable to one of said platform layer members;

(g) a plurality of alignment members securable to respective anchors on said bottom portion, and wherein said platform layer members define holes for receiving said alignment members, said holes allowing for the alignment members to pass through and be retained by said platform and to reach said bottom portion of said housing, and wherein said platform layer members have outer contours that are shaped differently from the bottom portion or sole to form a representation of an object not associated with a part of a shoe.

5. A kit as in claim 4, wherein said connection members are snaps about which said platform layer members are molded.

6. A platform shoe kit for assembling a shoe with a platform of selectable configuration, comprising:

(a) a housing portion for housing the foot of the wearer and comprising a bottom portion for supporting the foot of the wearer, said bottom portion having an upper support surface;

(b) one or more platform layer members, said platform layer members being securable to one another and to said bottom portion of said housing portion; and (c) a sole securable to the bottom of one of said platform layers;

(d) a plurality of anchors secured to said bottom portion;

(e) a plurality of alignment members securable by said anchors to said bottom portion, and wherein said platform portions define holes for receiving said alignment members and allow the alignment members to pass through said platform portion to reach said anchors on said bottom portion of said housing portion, said anchors comprising a threaded portion and retainer portion.

7. A platform shoe kit for assembling a shoe with a platform of selectable configuration as in claim 6, wherein said retainer portion has the configuration of a nut.

8. A platform shoe kit for assembling a shoe with a platform of selectable configuration as in claim 7, wherein said retainer portion has threads.

9. A platform shoe kit for a shoe with a platform of selectable configuration, comprising:

(a) a housing portion for housing the foot of the wearer and comprising a bottom portion for supporting the foot of the wearer, said bottom portion having an upper support surface for supporting the foot of the wearer, and a lower support surface;

(b) one or more platform layer members, said platform layer members being securable to one another and to said bottom portion of said housing portion, and having first and second surfaces;

(c) first connection members secured to the first sides of said platform layer members;

(d) second connection members secured to the second sides of said platform layer members, said second connection members mating with and engaging said first connection members;

(e) a sole member; and (f) a sole connection member secured to said sole member and securable to one of said platform layer members; and (g) a plurality of alignment members securable to respective anchors on said bottom portion, and wherein said platform layer members define holes for receiving said alignment members, said holes allowing for the alignment members to pass through and be retained by said platform and to reach said bottom portion of said housing, said anchors further comprising a threaded portion and retainer portion.

10. A platform shoe kit for a shoe with a platform of selectable configuration, comprising:

(a) a housing portion for housing the foot of the wearer and comprising a bottom portion for supporting the foot of the wearer, said bottom portion having an upper support surface;

(b) one or more platform layer members, said platform layer members being securable to one another and to said bottom portion of said housing portion, and having first and second sides;

(c) adhesive members secured to the first sides of said platform layer members;

(d) a sole member; and (e) a sole connection member secured to said sole member and securable to one of said platform layer members;

(f) a plurality of anchors secured to said bottom portion; and (g) a plurality of alignment members securable to said anchors, wherein said platform portions define holes for receiving said alignment members said holes allowing for the alignment members to pass through said platform to reach said bottom portion of said housing, said anchors each comprising a threaded portion and a retainer portion.

* * * * *